US006568958B2

(12) United States Patent
Zhang et al.

(10) Patent No.: US 6,568,958 B2
(45) Date of Patent: May 27, 2003

(54) ELECTRICAL CONNECTOR HAVING IMPROVED PERFORMANCE REGARDING RESISTANCE TO HIGH VOLTAGE PENETRATION

(75) Inventors: Guohua Zhang, Kunsan (CN); ZiQiang Zhu, Kunsan (CN); Jinkui Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,567

(22) Filed: Dec. 20, 2001

(65) Prior Publication Data

US 2002/0081902 A1 Jun. 27, 2002

(30) Foreign Application Priority Data

Dec. 21, 2000 (TW) ..... 89222271

(51) Int. Cl.[7] ..... H01R 13/648
(52) U.S. Cl. ..... 439/607; 439/540.1
(58) Field of Search ..... 439/607, 609, 439/676, 540.1, 344, 941

(56) References Cited

U.S. PATENT DOCUMENTS 5,842,886 A * 12/1998 Illg et al. ..... 439/607
6,129,587 A * 10/2000 Huang ..... 439/607
6,155,878 A * 12/2000 Chen ..... 439/607
6,290,535 B1 * 9/2001 Lin et al. ..... 439/541.5
6,402,562 B1 * 6/2002 Chang et al. ..... 439/676

* cited by examiner

*Primary Examiner*—Hien Vu
(74) *Attorney, Agent, or Firm*—Wei Te Chung

(57) ABSTRACT

An electrical connector (1) comprises an insulating housing (10) defining first and second receiving slots (12, 14) receiving first and second terminal inserts (23, 25), respectively. A plurality of first and second terminals (22, 24) are insert molded with the first and second terminal inserts. The first and second terminals include contact portions (22*b*, 24*b*), solder portions (22*c*, 24*c*), and arcuate portions (22*a*, 24*a*) between the solder portions and the arcuate portions. A shield (40) comprises a top wall (42) tightly enclosing a top surface (10*c*) of the housing. The top wall defines an opening (42*a*) at a position below which the arcuate portions of the first terminals are arranged, thereby preventing the first terminals from being damaged by high electrostatic charge.

1 Claim, 5 Drawing Sheets

ELECTRICAL CONNECTOR HAVING IMPROVED PERFORMANCE REGARDING RESISTANCE TO HIGH VOLTAGE PENETRATION

BACKGROUND OF THE INVENTION

1. Field of the Invention

The present invention relates to an electrical connector, and particularly to an electrical connector with improved high voltage penetration resisting performance.

2. Description of Related Art

Referring to FIG. 5, a conventional electrical connector comprises an insulating housing 60 defining first and second receiving slots 62 and 64 to receive first and second terminal inserts 70 and 72 therein, respectively. A plurality of terminals 71 and 73 are insert molded with the terminal inserts 70 and 72, respectively. Two board locks 66 are secured to the housing 60 to fix the connector to a printed circuit board. A shield 90 is attached on the housing 60 to shield the housing 60 and the terminals 71 and 73. However, to such a mini-type connector, a minimum distance between a top wall 92 of the shield 90 and exposed arcuate portions 71*a* of the terminals 71 is only about 0.3 mm which does not fit the industry standard (not less than 2.5 mm). It is well known that a good performance in resisting high voltage penetration is essential to the reliability of the connector. However, such a conventional design is apt to cause electrical current flowing from the shield 90 to the terminals 71 when a high voltage (1500 V) is applied to the shield 90, resulting in a failure of the connector. To resolve the problem, the shield is relocated to be far away from the terminals to increase the distance therebetween. However, this causes the connector to be too bulky to be accepted by the industry.

SUMMARY OF THE INVENTION

Accordingly, the object of the present invention is to provide an electrical connector having improved high voltage penetration resisting performance.

To fulfill the above-mentioned object, an electrical connector of the present invention comprises an insulating housing and a shield having a top wall shielding a top surface of the housing. The housing defines first and second receiving slots receiving first and second terminal inserts therein, respectively. A plurality of first and second terminals are insert molded with the first and second terminal inserts, respectively. The terminals include contact portions, solder portions and arcuate portions between the contact portions and the solder portions. The arcuate portions of the terminals are directly exposed to the top wall of the shield. The top wall of the shield defines an opening at a position below which the arcuate portions of the terminals are arranged, thereby increasing a minimum distance between the top wall of the shield and the arcuate portions of the terminals to prevent the terminals from being damaged by high electrostatic charge.

Other objects, advantages and novel features of the invention will become more apparent from the following detailed description of the preferred embodiment when taken in conjunction with the accompanying drawings.

DETAILED DESCRIPTION OF THE INVENTION

Figure 1:
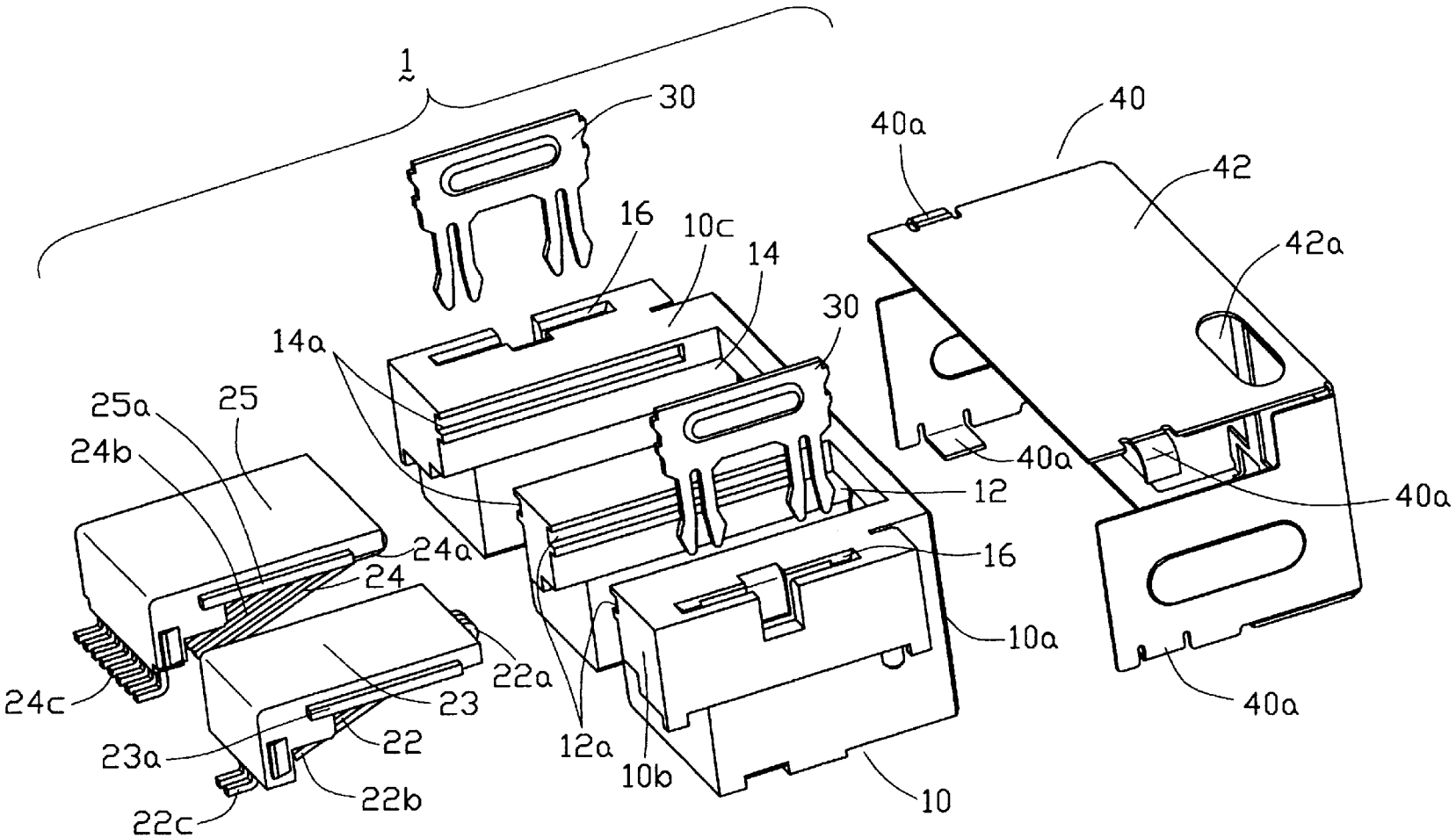
FIG. 1 is an exploded view of an electrical connector of the present invention.

Reference will now be made to the drawing figures to describe the present invention in detail.

Referring to FIG. 1, an electrical connector 1 of the present invention includes an elongated insulating housing 10 receiving first and second terminal inserts 23 and 25 therein, a pair of slits 16 beside the terminal inserts 23 and 25 receiving a pair of board locks 30 therein, and a shield 40 shielding the housing 10.

The housing 10 defines first and second receiving slots 12 and 14, and two pair of guide channels 12*a* and 14*a* in the receiving slots 12 and 14. The terminal inserts 23 and 25 define two pair of guide posts 23*a* and 25*a* corresponding to guide channels 12*a* and 14*a* of the housing 10.

A plurality of first and second terminals 22 and 24 are insert molded with the terminal inserts 23 and 25, respectively. The terminals 22 and 24 include solder portions 22*c* and 24*c* to be soldered to a printed circuit board (not shown), contact portions 22*b* and 24*b* for contacting mating terminals (not shown), and arcuate portions 22*a* and 24*a* between the solder portions 22*c*, 24*c* and the contact portions 22*b*, 24*b*. The arcuate portions 22*a* and 24*a* extend beyond front ends of the terminal inserts 23 and 25 and exposed to the shield 40.

The shield 40 comprises a top wall 42 enclosing a top surface 10*c* of the housing 10 and a plurality of securing portions 40*a* engaged to the housing 10. The top wall 42 defines an opening 42*a* at a position below which the arcuate portions 22*a* of the first terminals 22 are arranged. The opening 42*a* allows a minimum distance between the arcuate portions 22*a* and the top wall 42 of the shield 40 to be not less than 2.5 mm which is required by certain industry standard, thereby preventing the first terminals 22 from being damaged by high electrostatic charge.

Figure 2:
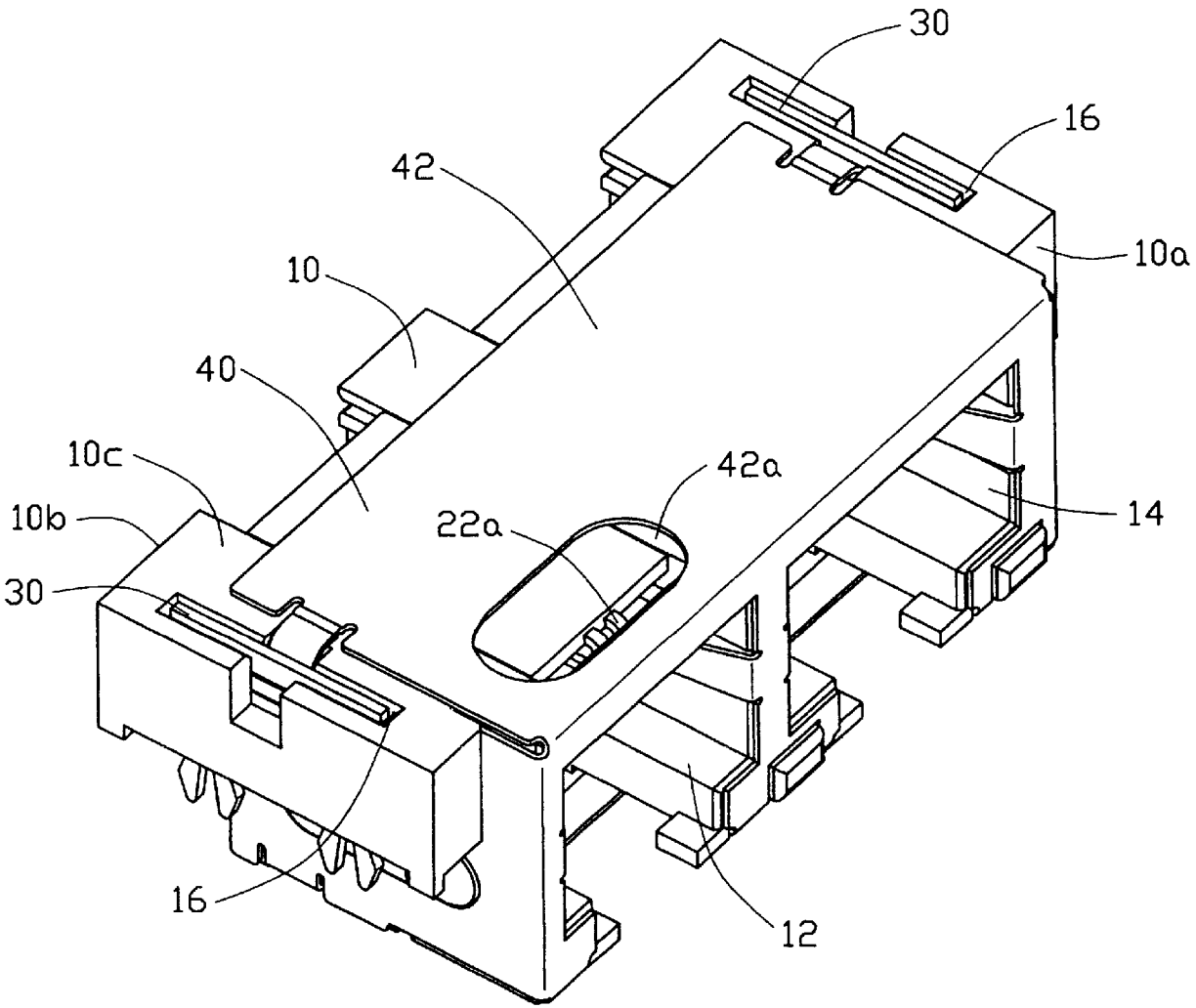
FIG. 2 is an assembled view of the electrical connector of FIG. 1.

Also referring to FIG. 2, in assembly, the terminal inserts 23 and 25 with the terminals 22 and 24 are respectively inserted into corresponding receiving slots 12 and 14 from a rear surface 10*b* of the housing 10 by guiding the guide posts 23*a* and 25*a* into guide channels 12*a* and 14*a* of the housing 10. The pair of locks 30 are inserted into the slits 16 from the top surface 10*c* of the housing 10. The shield 40 is then assembled to the housing 10 from a front surface 10*a* by properly positioning the opening 42*a* of the top wall 42 over the arcuate portions 22*a* of the first terminals 22.

Figure 3:
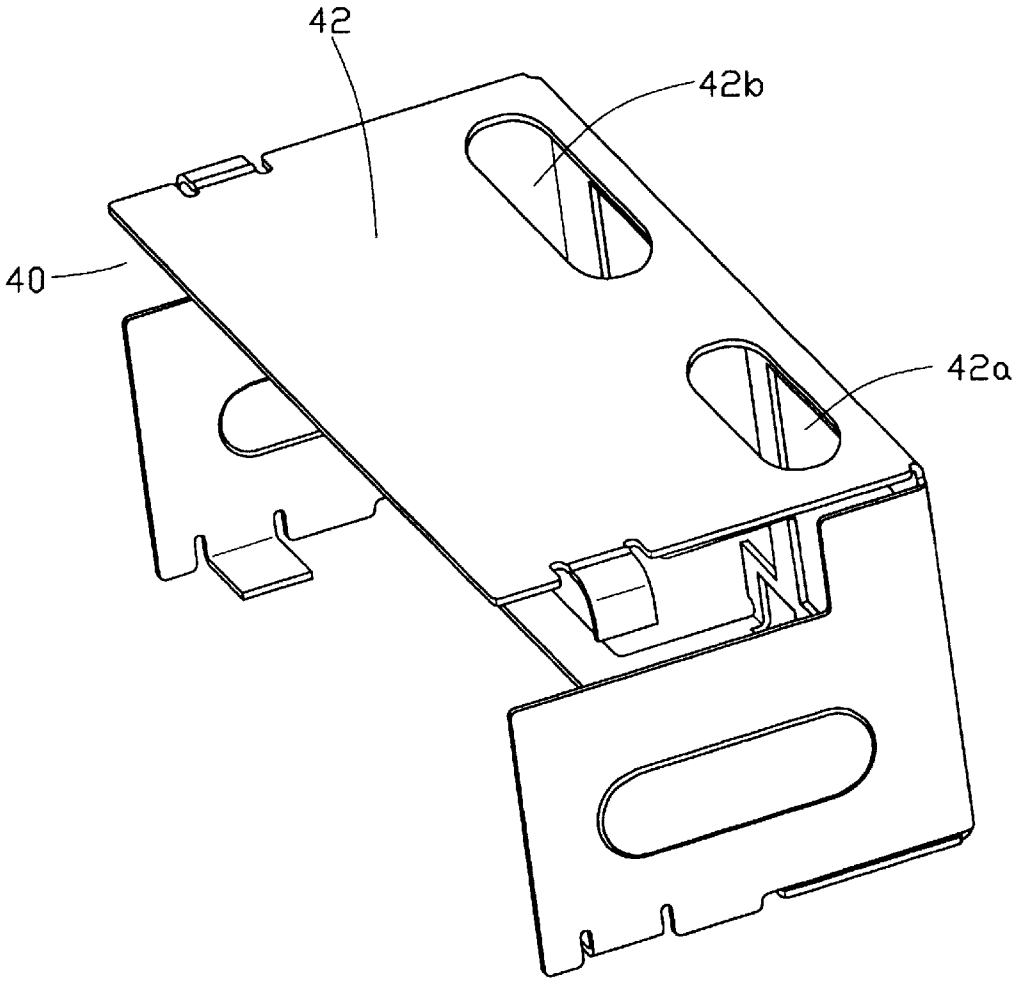
FIG. 3 is a perspective view of a shield of a second embodiment of the present invention.

FIG. 3 shows a shield of a second embodiment of the present invention. It differs from the first embodiment in that the top wall 42 of the shield 40 also defines an opening 42*b* over the arcuate portions 24*a* of the second terminals 24. The opening 42*b* performs similar function to the opening 42*a* so that it will not be detailed here.

Figure 4:
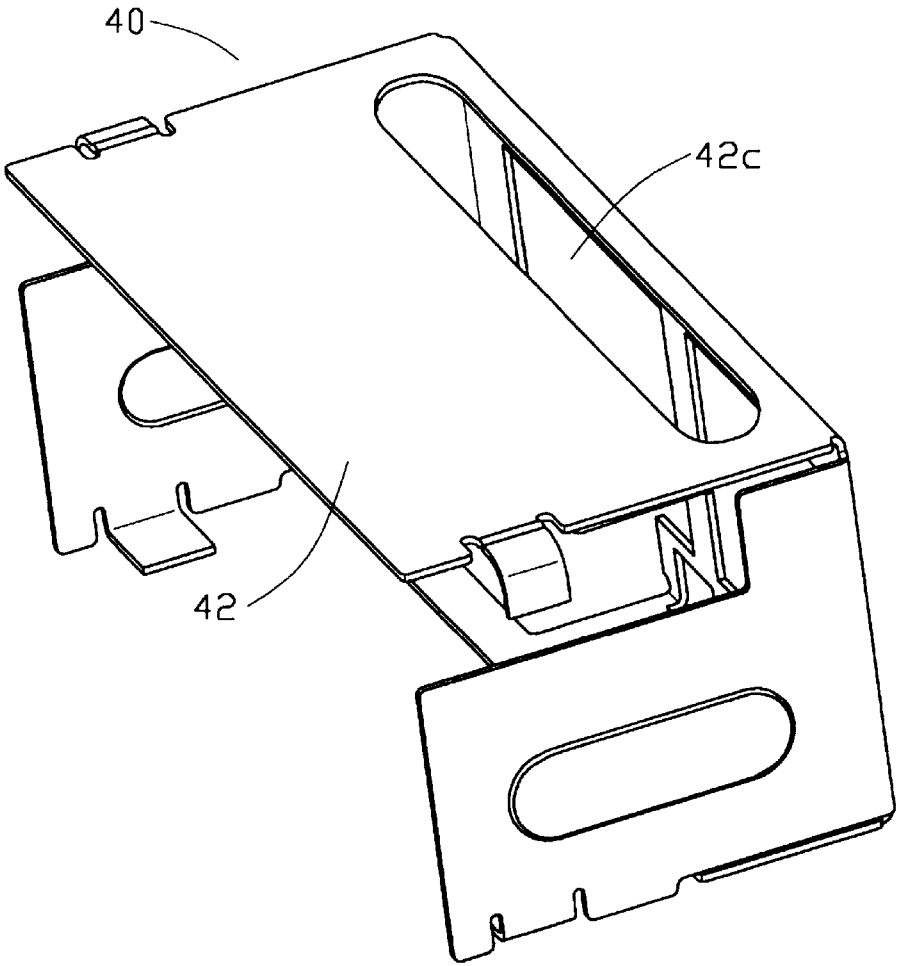
FIG. 4 is a perspective view of a shield of a third embodiment of the present invention.
Figure 5:
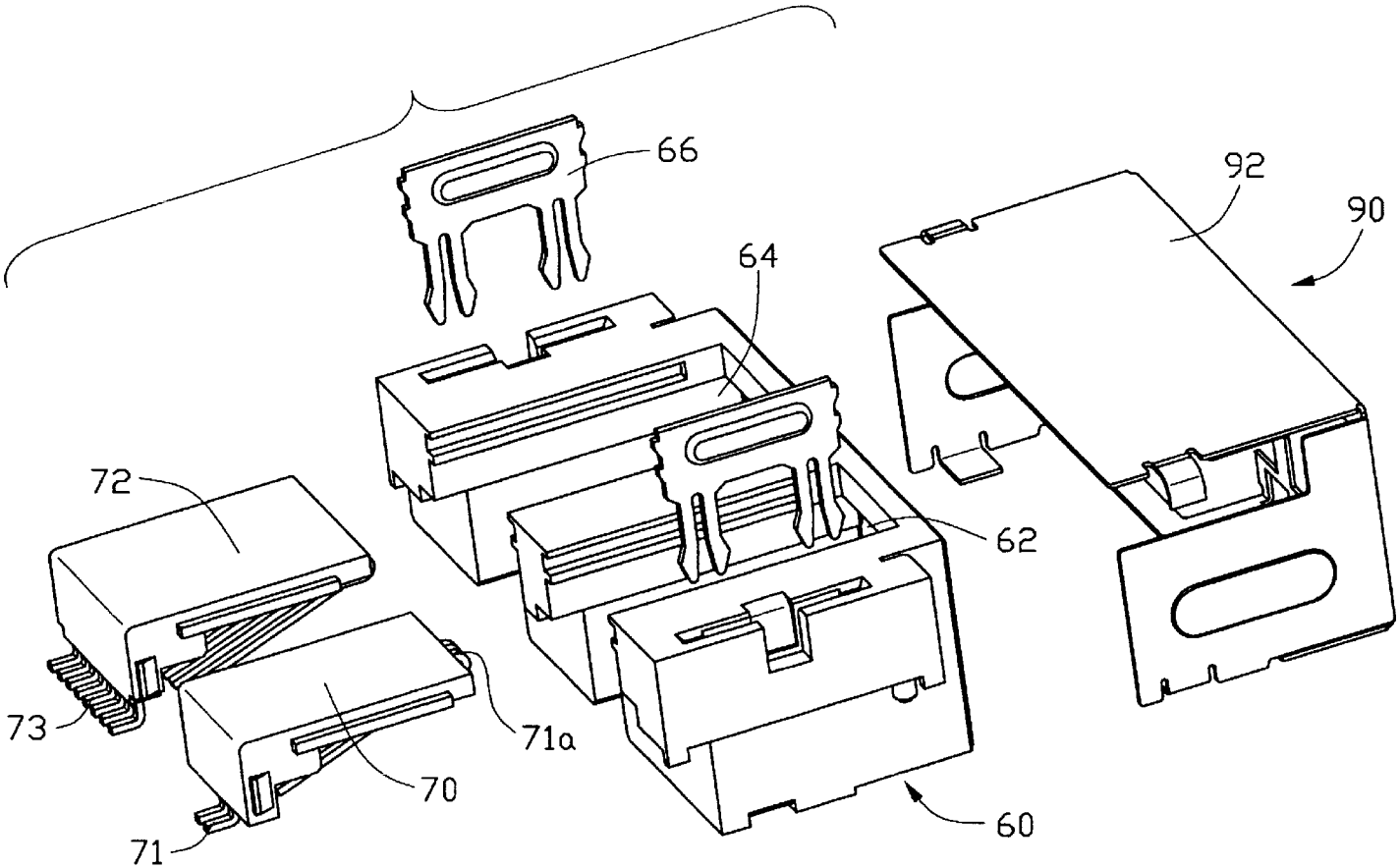
FIG. 5 (RELATED ART)
FIG. 5 is an exploded view of a conventional electrical connector.

Referring to FIG. 4, a shield of the third embodiment of the present invention defines a large opening 42*c* encompassing otherwise present openings 42*a* and 42*b* to benefit a manufacturing process.

An advantage of the present invention is that the distance between the arcuate portions of the terminals and the shield is not less than 2.5 mm thereby meeting the industry standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a receiving slot and a pair of slits beside the receiving slot thereof;

a metal shield having a top wall and side walls assembled to the housing from a front surface thereof and at least enclosing a top surface and side surfaces of the housing, the shield including a plurality of securing portions extending from the top and side walls for engaging with slots of the top and the side surfaces of the housing; and a plurality of terminals molded with an insulating terminal insert received within the receiving slot from a rear surface of the housing, said terminals defining arcuate portions located around a front portion of a horizontal face of the housing where said receiving slot is open to an exterior in a vertical direction; and a pair of board locks secured into the slits from the top surface of the housing to secure the connector to a printed circuit board;

wherein the shield defines an opening over the portions of the terminals and a minimum distance between the portions of the terminals and the shield is not less than 2.5 mm.

* * * * *